US005609044A

United States Patent [19]

Tacy

[11] Patent Number: 5,609,044

[45] Date of Patent: Mar. 11, 1997

[54] DURABLE KNITTING MACHINE CYLINDER ASSEMBLY AND METHOD OF MAKING SAME

[75] Inventor: Elizabeth K. Tacy, Monroe, N.C.

[73] Assignee: Monarch Knitting Machinery Corp., Glendale, N.Y.

[21] Appl. No.: 588,743

[22] Filed: Jan. 19, 1996

[51] Int. Cl.[6] ..... D04B 9/08

[52] U.S. Cl. ..... 66/115; 66/8; 66/114

[58] Field of Search ..... 66/8, 114, 115

[56] References Cited

U.S. PATENT DOCUMENTS

| | | | |
|---|---|---|---|
| 1,952,928 | 3/1934 | Lawson . | |
| 2,120,796 | 6/1938 | Coile . | |
| 2,127,537 | 8/1938 | Schuricht | 66/115 |
| 2,504,316 | 4/1950 | Fontaine | 66/114 X |
| 2,596,535 | 5/1952 | Curtis . | |
| 2,951,355 | 9/1960 | Bryant . | |
| 3,176,479 | 4/1965 | Noll | 66/115 |
| 3,230,742 | 1/1966 | Roedel . | |
| 3,301,014 | 1/1967 | Weisinger | 66/115 |
| 3,664,155 | 5/1972 | Guell | 66/115 |
| 3,667,113 | 6/1972 | Philip | 66/115 X |
| 3,817,058 | 6/1974 | Lombardi . | |
| 5,077,990 | 1/1992 | Plath . | |
| 5,398,526 | 3/1995 | Liu . | |

FOREIGN PATENT DOCUMENTS

| | | | |
|---|---|---|---|
| 591365 | 7/1925 | France | 66/115 |
| 707390 | 5/1941 | Germany | 66/115 |

*Primary Examiner*—John J. Calvert

*Attorney, Agent, or Firm*—Bell, Seltzer, Park & Gibson, P.A.

[57] ABSTRACT

A durable cylinder assembly for a circular knitting machine is described. The cylinder assembly includes a cylinder body including an upper face and an outer cylindrical face and having a plurality of spaced-apart, substantially radial slots. A plurality of first inserts are positioned within the slots and extend outwardly therefrom to define a series of needle-receiving channels. The first inserts are angled to define first and second legs. The first leg of each first insert is positioned within one of the slots and the second leg extends across the upper face of the cylinder body to define a bearing surface for reciprocating elements of the knitting machine, e.g. the sinkers and/or needles. The second legs are spaced apart from each other to define passages therebetween. A plurality of second substantially T-shaped inserts is provided with the stem of each insert extending within one of the passages formed by the first inserts. an upper portion of each second insert is preferably flared to enable it to be supported on the first inserts, while spaces between adjacent second inserts are adapted to receive reciprocating elements of the knitting machine. A method of improving the durability of a knitting machine cylinder by applying such a hardened circular band to the cylinder is also described.

25 Claims, 2 Drawing Sheets

DURABLE KNITTING MACHINE CYLINDER ASSEMBLY AND METHOD OF MAKING SAME

FIELD OF THE INVENTION

The invention relates generally to a durable, wear-resistant cylinder for a circular knitting machine, and more specifically to a cylinder assembly using a plurality of first and second hardened inserts which matingly engage an upper portion of a knitting machine cylinder to define wear surfaces for reciprocating elements of the knitting machine.

BACKGROUND OF THE INVENTION

Conventional knitting machine cylinders generally include four main parts: a cylinder body, a sinker ring or dial, a top ring, and a plurality of metal inserts. The outer cylindrical face of the cylinder body is typically machined to form spaced-apart, radial slots in which metal inserts are individually positioned. The metal inserts, which typically terminate proximate the upper edge of the cylinder body, extend radially outward beyond the slots to define a trick between each pair of adjacent inserts. These tricks receive the needles of the knitting machine, and act as guides for the vertical reciprocating needle motion.

The top ring is conventionally formed as a separate single element which is secured to the top of the cylinder. Prior to its securement to the cylinder body, the top ring is typically machined so that it includes a plurality of radial slots for receiving the sinkers. This machining process must be very precise, in order that the slots in the top ring will align correctly with the slots in the outer cylindrical face of the cylinder body. Thus, machining of the top ring can be time consuming and expensive.

When the top ring is secured to the top of the knitting machine cylinder, it provides support for lower surfaces of the sinkers, i.e. the bottoms of the sinker pawls, and for the backs of the needles. Because the reciprocating motions of the sinkers and needles generate large amounts of frictional forces along the wear surfaces of the top ring, it can become worn after only a minimal amount of use. Further, the tensional forces exerted by the knitted fabric being drawn down from the machine tend to localize the forces along the top ring, thereby exacerbating the problem of top ring wear.

To counter the effects of these frictional forces and minimize the resultant wear incurred, top rings have historically been heat treated in order to harden them so that they will be more resistant to wear. Heat treatment, however, often results in deformation of the top ring due to expansion, contraction and/or warping of the ring material. As discussed above, the top ring must be precisely shaped in order that it cooperates properly with the cylinder body; thus, deformations resulting from the heat treatment of the top ring must be corrected prior to its use. Correction of such top ring defects is typically expensive and time consuming, and thus can represent a significant cost of knitting machine production and operation. Further, because these prior arrangements require machining and slotting of two individual parts, i.e. the cylinder body and the top ring, manufacture of the machines tends to be relatively slow and expensive. Additionally, because the top ring is typically formed as a single continuous piece, top ring damage or wear, which may occur in a discrete area, usually requires replacement of the entire top ring, though a major portion of the ring is still in usable condition. Further, with conventional machining and heat treating processes, it is often difficult to achieve highly polished surfaces; the resulting rough surfaces are undesirable because they increase the amount of frictional forces produced during the knitting process and contribute to the build up of lint, which can interfere with the function of the machine.

FIGS. 1–3 depict such a typical prior art cylinder assembly for a circular knitting machine, shown generally at 10. The cylinder assembly includes a cylinder body 12, which has a plurality of spaced-apart radially extending walls 14, between which are defined a plurality of slots 16. An insert 18 is positioned within each of the slots 16, with each of the inserts extending outwardly beyond the walls 14 to define needle-receiving channels (commonly referred to as tricks) 20 between adjacent inserts.

A top ring 22 is secured to an upper face of the cylinder body 12, such as by a screw 28 which extends through an opening 30 in the top ring and a threaded opening 32 in the cylinder body. As illustrated, the inserts 18 typically terminate below the top ring 22 such that the top ring assists in their securement to the cylinder body 12.

The top ring 22 includes a plurality of upwardly extending walls 24 along its upper surface, with the walls being spaced apart to define sinker receiving channels 26. As discussed above, the top ring 22 typically provides bearing surfaces for reciprocating needles (not shown) positioned within the tricks 20 and for sinkers (not shown) which extend through the channels 26 on the top ring. Because large amounts of frictional forces tend to be produced by the reciprocating motions of the needles and sinkers, the bearing surfaces tend to wear adversely. Thus the top ring 22 is typically heat treated to harden it so that the ring is better able to withstand such frictional forces and wear is minimized. As illustrated in FIGS. 1–3, the mating engagement of the top ring 22 to the cylinder body 12 must be tight and accurate in order that the moving elements of the knitting machine are properly aligned with the channels in which they reciprocate. Thus, any warping or other deformation which results from the heat treatment must be corrected before the cylinder can be effectively utilized. As a result, the machined, heat treated top ring tends to be expensive to produce and expensive to replace.

Other attempts have been made to overcome the deleterious effects of the frictional forces on the knitting machine cylinder. For example, U.S. Pat. No. 3,230,742 to Roedel describes a replaceable synthetic insert for increasing resistance of the inner sinker ring to frictional wear. A replaceable insert in the form of a ring is bonded by a layer of adhesive to the top of the inner sinker ring. The insert is then machined to provide guides for the sinkers and needles. Because the insert must be machined to define slots for the sinkers, the manufacturer must be particularly exact in slotting the insert in order that it will correspond appropriately to the slots containing the inserts in the outer cylindrical face of the cylinder body. Additionally, because the insert is a continuous circular band, there is no provision for any adjustment in its circumference, and the entire band may require replacement following damage to a single portion thereof.

U.S. Pat. No. 1,952,928 to Lawson describes a needle cylinder, the upper edge of which contains a plurality of grooves in which a plurality of inserts are frictionally engaged. The inserts are described as providing guidance for the horizontal motion of the sinkers and they may be connected by extensions to form sections of a sectional top ring. There is no provision, however, for making the individual inserts resistant to the frictional forces provided by the movement of the sinkers and needles. Similarly, there is no provision for supporting the underside, or pawls, of the sinkers.

U.S. Pat. No. 5,077,990 to Plath describes a friction reducing surface applied to a conventional slotted top ring of a circular knitting machine. Though this top ring is treated to reduce the amount of wear it receives, it requires the formation of slots therein. Thus, when the top ring is replaced, a new top ring must be accurately slotted to match the slots in the outer cylinder body face. Further, because the top ring is formed as a single unit, wear in a discrete area can require replacement of the entire top ring.

Thus, a need exists for a cylinder structure for a knitting machine which can withstand the deleterious effects of the frictional forces produced by the sinker and/or needle movements, which can be readily and easily replaced, and which can be inexpensively fabricated.

Further, a need exists for a cylinder assembly for a circular knitting machine which can be hardened by conventional heat treatment processes and which can allow discrete regions which may become damaged to be replaced without requiring replacement of an entire top ring.

Additionally, a need exists for a cylinder assembly which reduces the amount of frictional forces produced during the knitting operation and the build up of lint on the machine.

SUMMARY OF THE INVENTION

With the foregoing in mind, it is an object of the present invention to provide a cylinder assembly for a circular knitting machine which provides durable wear surfaces for the reciprocating elements of the knitting machine, which can be readily and easily produced, and which can be formed to have highly polished surfaces.

It is a further object of the invention to provide a heat treated wear surface for the reciprocating elements of a knitting machine which does not require replacement of an entire top ring as a result of wear or damage to a discrete area.

An additional object of the present invention is to provide a method for increasing the lifespan of a knitting machine by providing the wear-prone areas of the knitting cylinder with a plurality of inserts which can withstand great amounts of frictional forces and which can be easily manufactured and applied to the machine.

It is a further object of the present invention to provide a durable wear surface assembly for the reciprocating elements of a knitting machine which can easily and inexpensively fabricated and readily replaced, in whole or in part, when it becomes worn, without the expenses or difficulties typically associated with replacement of a top ring or cylinder body.

These and other objects are achieved by providing a cylinder assembly for a circular knitting machine which can withstand the frictional forces commonly associated with the reciprocating movements of the sinkers and/or needles. The cylinder assembly desirably has a cylinder body having an outer cylindrical face and an upper face. The cylinder body desirably has a plurality of spaced-apart outwardly extending walls on its outer cylindrical face, between which are defined a plurality of slots. Each slot is adapted to receive the first leg of a substantially L-shaped insert. The first leg of each insert preferably extends outwardly beyond the walls, such that adjacent inserts define needle-receiving channels or tricks therebetween.

A second leg of the substantially L-shaped insert, which preferably extends at approximately a 90° angle relative to the first leg, is adapted to extend over the upper face of the cylinder body to define a wear surface for the horizontally reciprocating elements of the knitting machine, e.g. the sinkers. In a preferred form of the invention, at least the second leg of the substantially L-shaped insert is treated to make it more resistant to wear. In a particularly preferred form of the invention, the inserts are made from metal and at least the second leg of each of the inserts is heat treated to harden it to between about 58 and 64 on the Rockwell C scale.

The second legs of the substantially L-shaped inserts are desirably spaced apart from each other along the upper face of the cylinder body, to define a series of upwardly extending, radial passages. In a particularly preferred form of the invention, the substantially L-shaped inserts are of substantially consistent width, so that the spacing between second legs of adjacent inserts approximates the width of the walls on the outer cylindrical face of the cylinder body.

A plurality of substantially T-shaped second inserts are positioned so that a stem of each of the second inserts is secured within one of the passages formed between adjacent pairs of second legs of the first inserts. The stem of each of the second inserts is preferably relatively narrow, and the insert desirably flares outwardly slightly at the insert top. In this way, the flared top portion can rest on the upper face of the first inserts to assist in the support of the second inserts in the proper position. However, the top portions of the second inserts are not flared to such an extent that adjacent inserts contact each other; rather, a series of upwardly extending, radial passages is desirably formed by the plurality of second inserts. These passages are adapted to receive horizontally reciprocating elements of the knitting machine, e.g. the sinkers, to provide horizontal guidance therefor. As a result, very precise alignment of the horizontally reciprocating knitting machine elements can be attained.

The lower portion or stem of the second insert desirably includes a knoblike protrusion. In this embodiment of the invention, the walls on the cylinder body are desirably notched, in order that the knoblike protrusion can matingly engage one of the notches. In this way, the second inserts can be made to securely engage the cylinder body. As will readily be appreciated, the shape of the mating protrusion and notch can be any of a variety of shapes, the selection of which will be a choice of the manufacturer.

The outwardly facing faces of the second inserts are preferably smooth and substantially planar. In this way, when the first and second inserts are positioned on a cylinder body, the outer face of each of the second inserts extends smoothly from the back of one of the tricks, which is formed by the outer face of the walls extending outwardly from the cylinder body. The outer faces of the second inserts thus can provide smooth wear surfaces for the backs of the needles (not shown).

In a preferred form of the invention, at least the second leg of each of the first inserts and the entire second inserts are treated to improve their wear resistance and durability. In a particularly preferred form of the invention, the respective portions of the inserts are heat treated to a hardness of between about 58 and 64 on the Rockwell C scale. The inserts are also desirably highly polished, particularly along their surfaces which are adapted to contact the reciprocating elements of the knitting machine, i.e. the upper face of the second leg of the first insert and the outer face of the second insert. In this way, the amount of frictional forces which are produced during the knitting operation are reduced, as is the tendency for lint to gather on the machine.

As can readily be seen, this cylinder assembly, by using the plurality of mating inserts, avoids many of the problems typically associated with conventional slotted top rings. For example, because the assembly does not require the machining of slots in a top ring, its manufacture is much simpler and less expensive. Further, the deformation which can result as a result of the heat treatment processes is less of a problem with the individual inserts, and any remachining which may be required is simpler and thus less expensive for the individual inserts as compared with that of a complete top ring. In addition, discrete segments of the cylinder assembly can easily be replaced should they become damaged or worn, without the unnecessary replacement of regions of the assembly which are still in workable condition. Furthermore, securement of the insert to the cylinder body is less tedious than for that of a typical top ring, since the problems associated with top ring slot alignment are avoided. Additionally, more highly polished surfaces can be achieved, thereby reducing frictional forces produced during the knitting process and the build up of lint. Further, due to the interrelationship of the first and second inserts to each other and the flaring of the second inserts, extremely accurate alignment of the horizontally reciprocating knitting machine elements, e.g. the sinkers, can be attained. Likewise, the assembly allows a great deal of versatility in that the width and size of the various inserts can be readily and easily selected to fit the particular machine to which they are to be applied.

Thus, the assembly of the present invention obviates the need for the machining and slotting of new top ring or cylinder body constructions following wear, and the delicate process of properly aligning such elements, thus eliminating these costly and time consuming processes. As a result, machine down time can be reduced by a great amount, and the expense typically associated with the frictional wear on the machine parts is greatly reduced.

BRIEF DESCRIPTION OF THE DRAWINGS

The foregoing and other objects, features, and advantages of the present invention will be made apparent from the following detailed description and from the drawings in which.

DETAILED DESCRIPTION OF THE PREFERRED EMBODIMENTS

Figure 4:
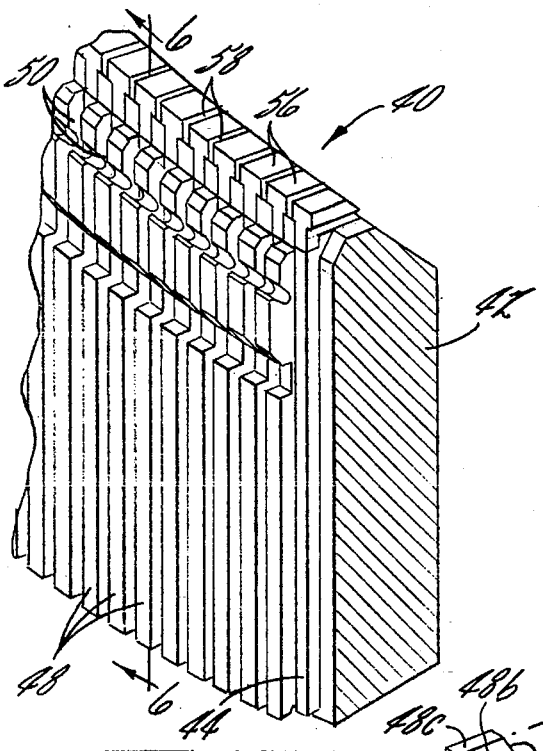
FIG. 4 is a sectional perspective view of a portion of a cylinder assembly having durable inserts according to the present invention.
Figure 5:
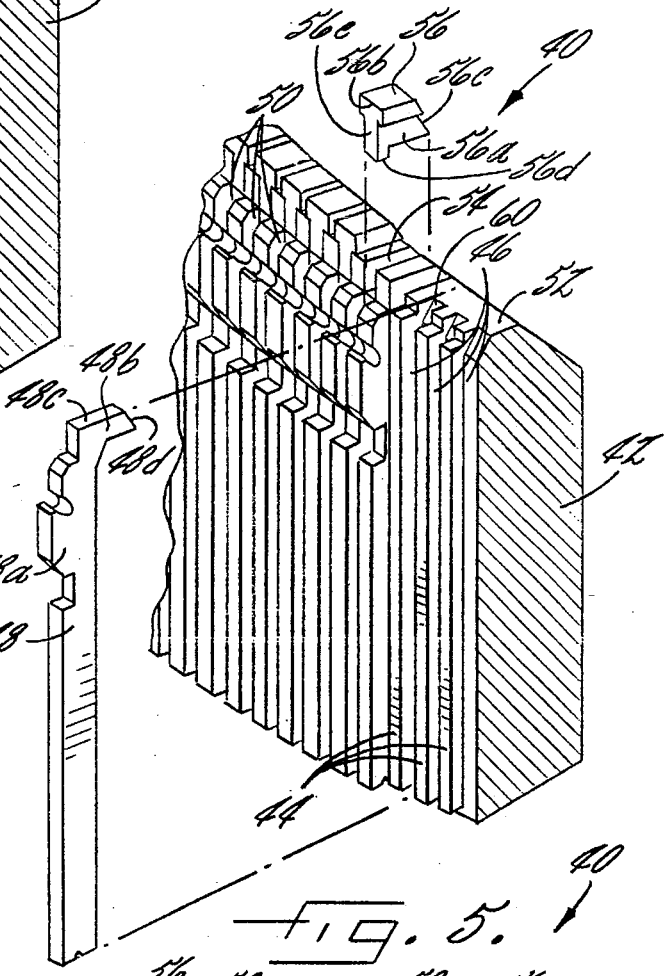
FIG. 5 is a partially exploded perspective view of a cylinder body and first and second insert assembly according to the present invention.
Figure 6:
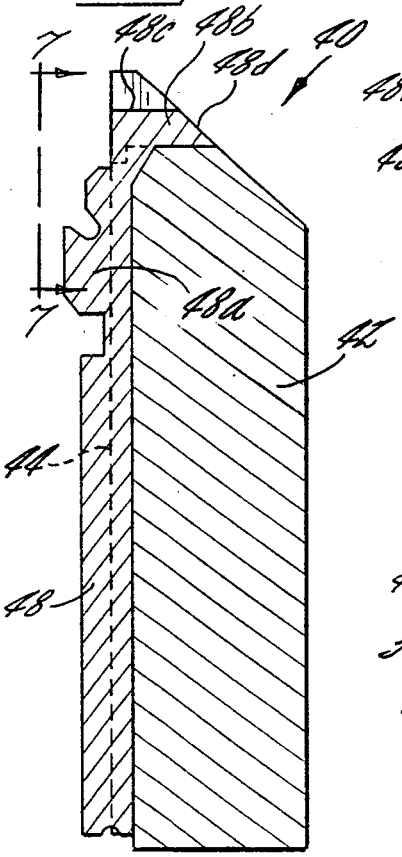
FIG. 6 is a cross-sectional elevational view of the cylinder assembly according to the present invention, taken along line 6—6 of FIG. 4.
Figure 7:
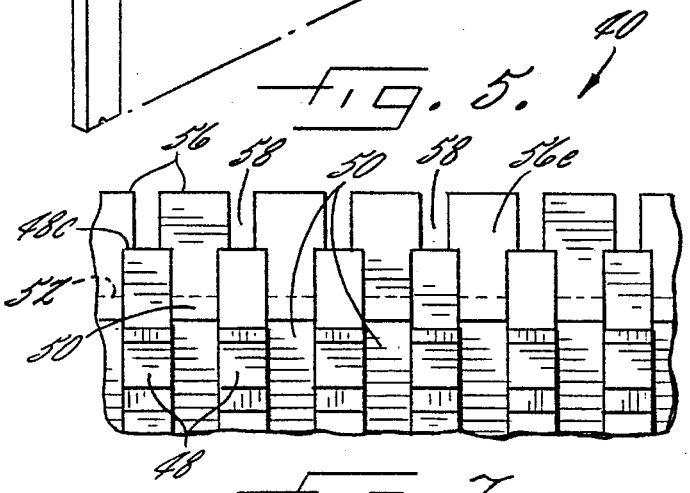
FIG. 7 is a radial elevational view of an upper region of a cylinder assembly according to the present invention in the direction of the arrows 7—7 in FIG. 6.
Figure 1:
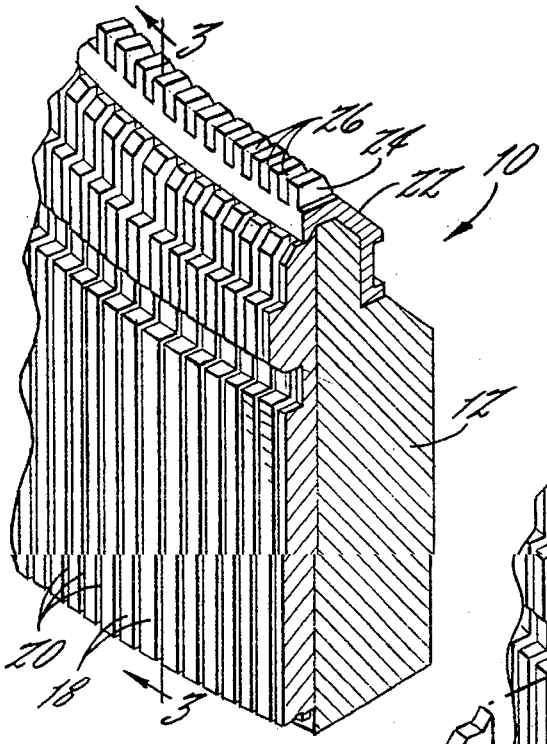
FIG. 1. PRIOR ART
FIG. 1 is sectional perspective view of a portion of one cylinder assembly known in the prior art, which includes a top ring and inserts attached thereto.
Figure 2:
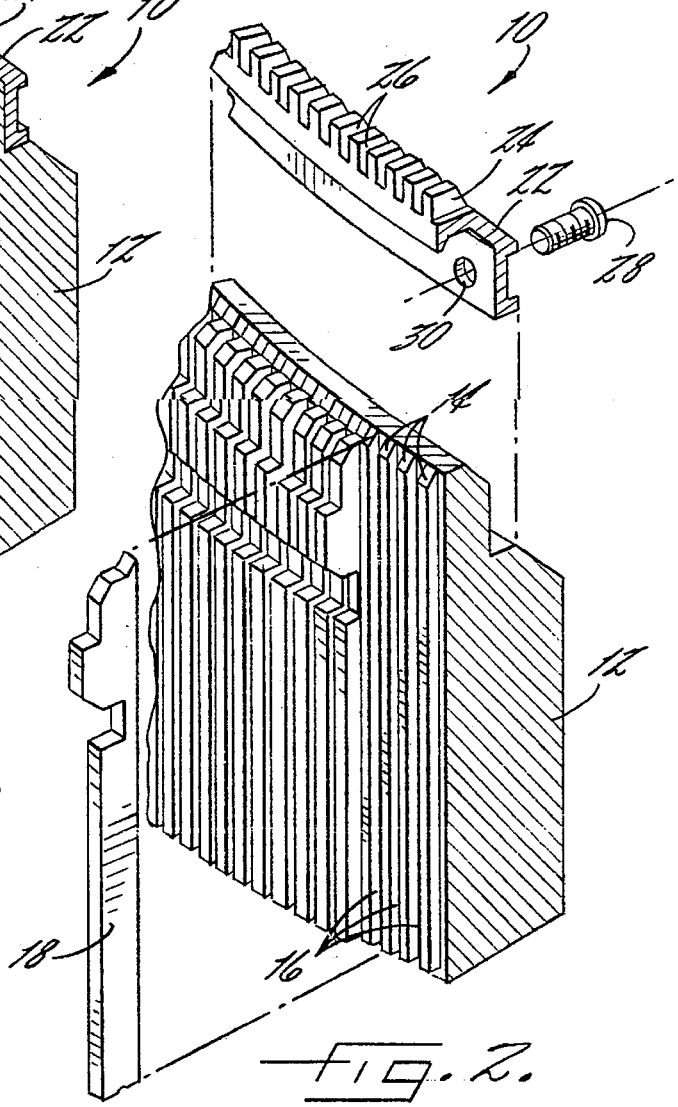
FIG. 2. PRIOR ART
FIG. 2 is an exploded view of the prior art cylinder body and top ring assembly shown in FIG. 1.
Figure 3:
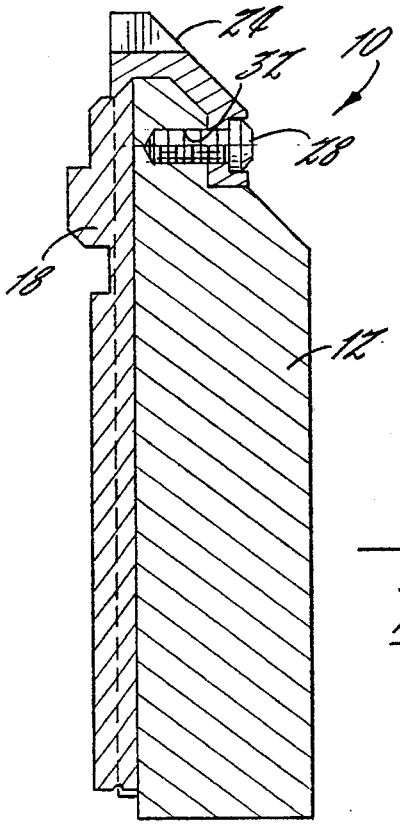
FIG. 3. PRIOR ART
FIG. 3 is a cross-sectional elevation view of the prior art cylinder assembly taken along line 3—3 of FIG. 1.

FIGS. 4 through 7 illustrate a cylinder assembly according to the present invention, as shown generally at 40. A cylinder body 42 is preferably machined to have a plurality of spaced apart, outwardly extending walls 44 on its outer cylindrical face, which define radial slots 46 between adjacent walls.

A first insert 48 is preferably positioned within each of the slots 46. The first insert 48 preferably includes a first leg 48*a* and a second leg 48*b* which extends at an angle to the first leg. In a particularly preferred form of the invention, the first insert 48 is substantially L-shaped such that the second leg 48*b* extends at approximately a 90° angle to the first leg 48*a*. The first legs 48*a* preferably extend outwardly beyond the walls 44 of the cylinder 42 to define channels (i.e., tricks) 50 between adjacent inserts 48 for receiving axially reciprocating elements of the knitting machine, such as cylinder needles.

The second leg 48*b* of each insert 48 is preferably adapted to extend across an upper face 52 of the cylinder body 42. The second leg 48*b* of the first insert 48 also desirably has a substantially planar upper face 48*c* and terminates along an angled face 48*d*. The upper face 48*c* extends radially at the upper portion of the cylinder body 42 to define a durable surface for a sinker, dial needle or other horizontal/radial reciprocating element. The angled face 48*d* can then cooperate with the typically slanted inner surface of the cylinder body 42 to define a smooth surface therealong. In this way, as a fabric is knitted on the knitting machine, there are no sharp edges formed at the juncture of the insert 48 and the cylinder body 42 which could tend to catch and/or pick the fabric.

The first insert 48 preferably has a substantially consistent width along the first and second legs 48*a* and 48*b*. In this way, when the insert 48 is positioned within the slots 46 on the cylinder body 42, spaced apart channels 54 are defined between the second legs 48*b* of adjacent first inserts, with the channels extending radially upward from the upper face 52 of the cylinder body A plurality of second inserts 56 are preferably positioned within the channels 54 between the second legs 48*b* of the inserts 48. Each second insert 56 preferably has a relatively narrow stem 56*a* which flares outwardly slightly at the insert top 56*b*, which results in a substantially T-shaped insert. In this way, the flared top portion 56*b* can rest on the upper face 48*c* of the first inserts 48 to assist in the support of the second inserts 56 in the proper position. However, the top portions 56*b* of the second inserts 56 are not flared to such an extent that adjacent inserts contact each other; rather, a series of upwardly extending, radial passages 58 is desirably formed by the series of inserts 56. These passages 58 are adapted to receive radially reciprocating elements of the knitting machine, e.g. sinkers or dial needles, to provide guidance therefor. As a result, very precise alignment of the radially reciprocating knitting machine elements can be attained. Further, because the upper faces 48*c* of the second legs 48*b* of the first inserts 48 form the bases of the passages 58, wear surfaces are provided for the radially reciprocating elements, such as sinker pawls or the backs of the dial needles.

The second inserts 56 also desirably include angled rear portions similar to the angled face 48*d* of the first insert 48. In this way, when the second inserts 56 are positioned within the channels 54 between the second legs 48*b* of first inserts 48, their back surfaces 56*c* follows the typical slanted contour of the cylinder body 42, and that of the first insert. As discussed above, this minimizes the potential for sharp edges to be formed at the junctures of the inserts 48, 56 and the cylinder body 42. As a result, the potential for the machine elements to pick the material as it is being knitted is greatly reduced.

The lower portion or stem 56*a* of the second insert 56 desirably includes a knoblike protrusion 56*d* proximate its outer face. In this embodiment of the invention, the walls 44 on the cylinder body 42 are desirably notched, as shown generally at 60, in order that the knoblike protrusion 56*d* can matingly engage one of the notches 60. In this way, the second inserts 56 can be made to securely engage the cylinder body 42. As will readily be appreciated, the shape of the mating protrusion 56*d* and notch 60 can be any of a variety of shapes, the selection of which will be a choice of the manufacturer.

The outwardly facing faces of the second inserts 56, shown generally at 56*e*, are preferably smooth and substantially planar. In this way, when the first and second inserts 48, 56 are positioned on a cylinder body 42 as previously described, the outer face 56*e* of each of the second inserts extends smoothly from the back of one of the tricks 50, which is formed by the outer face of the walls 44 extending outwardly from the cylinder body 42. The outer faces 56*e* of the second inserts 56 thus can provide smooth wear surfaces for axially reciprocating elements of the knitting machine, such as the backs of cylinder needles (not shown).

In a preferred form of the invention, at least the second leg 48*b* of each of the first inserts and the entire second inserts 56 are treated to improve their wear resistance and durability. In a particularly preferred form of the invention, the inserts 48, 56 are metal, and the respective portions are heat treated to a hardness of between about 58 and 64 on the Rockwell C scale. The inserts 48, 56 are also desirably highly polished, particularly along their surfaces which are adapted to contact the reciprocating elements of the knitting machine, i.e. the upper face 48*c* of the second leg 48*b* of the first insert 48 and the outer face 56*e* of the second insert 56. In this way, the amount of frictional forces which are produced during the knitting operation are reduced, as is the build up of lint.

The method of constructing a cylinder assembly according to the present invention is as follows. The cylinder body 42 is machined to have an upper face 52 and an outer cylindrical face having a plurality of spaced-apart, outwardly extending walls 44 which define radial slots 46 therebetween. Where desired, these walls 44 can be machined to have notches 60 formed along upper portions thereof, so that the notches can matingly engage protrusions formed on the second inserts, as discussed further herein.

A plurality of first inserts 48 are machined to have first and second legs 48*a*, 48*b*, which extend at an angle to each other. Particularly preferred are substantially L-shaped inserts, as discussed above. The first inserts 48 are preferably treated, such as by conventional heat treating processes, to improve their wear resistance, and they are also desirably polished to provide very smooth surfaces. The first inserts 48 are positioned within the slots 46 in the cylinder body 42 such that their first legs 48*a* extend along the outer cylindrical face of the cylinder body and their second legs 48*b* extend across the upper face 52 of the cylinder body. This securement can be assisted through the use of conventional adhesives or the like.

Second inserts 56 are machined, preferably to have relatively narrow stems 56*a* which flare outward at the top of the insert 66*b* to form a substantially T-shaped body. However, the inserts may instead have substantially continuous, planar sidewalls. The second inserts 56 may also be machined to include a knob-like protrusion about their stems 56*a* which can be shaped to matingly fit with the notches 60 formed in the walls 44 of the cylinder body 42. The second inserts 56 are desirably treated to improve their wear resistance, such as by conventional heat treatment processes. The second inserts may also be polished to enhance their surface smoothness.

The second inserts 56 are then positioned such that their stems 56*a* extend into channels formed between adjacent second legs 48*b* of the first inserts 48, and so that their protrusions 56*a* matingly fit within the notches 60 formed in walls 44 in the cylinder body 42. The securement of the second inserts 56 to the first inserts 48 and the cylinder body 42 can be assisted by way of conventional adhesives or the like. In a similar manner, should a portion of the cylinder assembly 40 become worn or damaged, those inserts 48, 56 corresponding to the damaged region can be removed, and replaced with new or reworked inserts. In this way, the damaged region can be repaired without requiring replacement of the entire assembly.

In the drawings and specification, there have been disclosed typical preferred embodiments of the invention and, although specific terms are employed, these terms are used in a descriptive sense only and not for purposes of limitation. The invention has been described in considerable detail with specific reference to various illustrated embodiments. It will be apparent, however, that various modifications and changes can be made within the spirit and scope of the invention as described in the foregoing specification and defined in the appended claims.

That which is claimed is:

1. A cylinder assembly for a circular knitting machine comprising:

a cylinder body including an outer cylindrical face having a plurality of spaced-apart, radial slots, and a plurality of first inserts, each of said inserts being positioned within one of said slots and having a radially extending upper face to define a bearing surface for reciprocating elements of the knitting machine, each of said first inserts being substantially L-shaped to define a first leg and a second leg, and each of said first inserts being positioned on said cylinder body such that said first leg of each of said first inserts is within one of said slots and said second leg of each of said first inserts extends across said upper face of said cylinder body.

2. The cylinder assembly according to claim 1, wherein the second legs of adjacent first inserts are spaced to define channels therebetween, with said channels extending radially upward from said upper face of the cylinder body.

3. The cylinder assembly according to claim 2, further comprising a plurality of second inserts, each of said second inserts being positioned within one of said channels to define a bearing surface for axially reciprocating elements of the knitting machine.

4. The cylinder assembly according to claim 3, wherein said second inserts are substantially T-shaped, with a stem of each of said second inserts being positioned within one of said channels.

5. The cylinder assembly according to claim 4, wherein upper portions of adjacent second inserts are spaced apart to define passages therebetween for receiving radially reciprocating elements of the knitting machine.

6. The cylinder assembly according to claim 4, wherein at least a portion of each of said first and second inserts have been treated to enhance their durability.

7. The cylinder assembly according to claim 6, wherein the portions which have been treated to enhance their durability have a hardness of between about 58 and 64 on the Rockwell C scale.

8. The cylinder assembly according to claim 4, wherein said slots in the outer cylindrical face of said cylinder body are defined by a series of radially extending walls, a plurality of said walls including a notch in an upper end thereof, and wherein a plurality of said second inserts include a protrusion on their respective stems, said protrusion being adapted to matingly engage one of said notches in the walls of the cylinder body.

9. The cylinder assembly according to claim 1, wherein said first inserts extend radially outward from said slots so as to define a series of channels therebetween for receiving axially reciprocating elements of a knitting machine.

10. An insert for positioning on the cylinder body of a circular knitting machine to define wear surfaces for reciprocating elements thereof, comprising:

a first leg for extending along and radially outwardly from an outer cylindrical face of the knitting machine cylinder body and a second leg extending at an angle to said first leg, said second leg extending substantially perpendicular to said first leg to overlie an upper face of the cylinder body to define a durable wear surface thereon.

11. The insert according to claim 10, wherein at least said second leg of the insert has been treated to enhance its wear resistance.

12. A method of improving the durability of a knitting machine cylinder comprising:

providing the cylinder with a series of first inserts by positioning a plurality of substantially L-shaped first inserts on the cylinder so that a second leg of each of the first inserts extends across an upper face of the cylinder in spaced apart relation from the second leg of an adjacent first insert such that channels extending radially upward from said upper face are defined therebetween and so as to define bearing surfaces for radially reciprocating elements of the knitting machine, and providing the cylinder with a series of second inserts which matingly engage the series of first inserts by positioning the second inserts within the upwardly extending channels defined by the first inserts to define bearing surfaces for axially reciprocating elements of the knitting machine.

13. The method according to claim 12, wherein the radially reciprocating elements comprise sinkers.

14. The method according to claim 12, wherein the axially reciprocating elements comprise needles.

15. The method according to claim 12, wherein upper portions of adjacent second inserts are spaced apart to define passages therebetween for receiving the radially reciprocating elements.

16. A cylinder assembly for a circular knitting machine comprising:

a cylinder body including an upper face and an outer cylindrical face having a plurality of spaced-apart, radial slots, and a plurality of first substantially L-shaped inserts, each first insert having a first leg positioned within one of said slots and a second leg extending across said upper face of the cylinder body to define a bearing surface thereon, and a plurality of second inserts positioned within spaces between adjacent second legs of said first inserts, said second inserts defining bearing surfaces for reciprocating elements of the knitting machine.

17. The cylinder assembly according to claim 16, wherein said first inserts define guides for positioning of axially reciprocating elements of the knitting machine and said second inserts define guides for positioning of radially reciprocating elements of the knitting machine, and bearing surfaces for axially reciprocating elements of the knitting machine.

18. The cylinder assembly according to claim 16, wherein at least the second leg of said first inserts and the second inserts have a hardness of between about 58 and 64 on the Rockwell C scale.

19. A circular knitting machine assembly comprising:

a cylinder body including an upper face and an outer cylindrical face having a plurality of spaced-apart, radial slots, and a plurality of elements positioned for horizontal reciprocating movement proximate said upper face of the cylinder body, and a plurality of first inserts, each of said inserts being positioned within one of said slots and having a second leg substantially perpendicular to a first leg and which second leg extends across said upper face to define a bearing surface for said elements positioned for horizontal reciprocating movement.

20. The knitting machine assembly according to claim 19, wherein said first inserts positioned within said slots in said outer cylindrical face of the cylinder body define a series of needle-receiving channels, and further comprising a plurality of needles positioned within said needle-receiving channels for vertically reciprocating movement therein.

21. The knitting machine assembly according to claim 20, wherein adjacent first inserts are spaced to define channels therebetween, with said channels extending radially upward from said upper face of the cylinder body, and further comprising a plurality of second inserts, each of said second inserts being positioned within one of said channels to define a bearing surface for one of said needles.

22. The knitting machine assembly according to claim 21, wherein upper portions of adjacent second inserts are spaced apart to define passages therebetween for receiving said elements positioned for horizontal reciprocating movement proximate said upper face of the cylinder body.

23. The knitting machine assembly according to claim 21, wherein at least a portion of each of said first and second inserts have been treated to enhance their durability.

24. The knitting machine assembly according to claim 19 wherein said elements positioned for horizontal reciprocating movement comprise sinkers.

25. A circular knitting machine assembly comprising:

a cylinder body including an upper face and an outer cylindrical face having a plurality of spaced-apart, radial slots, and a plurality of elements positioned for horizontal reciprocating movement proximate said upper face of the cylinder body, and a plurality of first inserts, each of said inserts being positioned within one of said slots and extending across said upper face to define a bearing surface for said elements positioned for horizontal reciprocating movement, wherein said first inserts positioned within said slots in said outer cylindrical face of the cylinder body define a series of needle-receiving channels, and further comprising a plurality of needles positioned within said needle-receiving channels for vertically reciprocating movement therein, and wherein adjacent first inserts are spaced to define channels therebetween, with said channels extending radially upward from said upper face of the cylinder body, and further comprising a plurality of second inserts, each of said second inserts being positioned within one of said channels to define a bearing surface for one of said needles, wherein at least a portion of each of said first and second inserts have been treated to enhance their durability, and wherein the portions which have been treated to enhance their durability have a hardness of between about 58 and 64 on the Rockwell C scale.

* * * * *

UNITED STATES PATENT AND TRADEMARK OFFICE
CERTIFICATE OF CORRECTION

PATENT NO. : 5,609,044

DATED : March 11, 1997

INVENTOR(S) : Tacy

It is certified that error appears in the above-identified patent and that said Letters Patent is hereby corrected as shown below:

Drawings:

The two sheets of drawings should be switched: "Sheet 1" should be --Sheet 2--; "Sheet 2" should be --Sheet 1--.

On the title page, U.S. Patent References, Col. 1, line 10, delete "Guell" and insert --Dalmau Güell-- therefor.

Col. 6, line 41, after "body" insert --42.--.

Col. 8, line 1, delete "66b" and insert --56b-- therefor.

Signed and Sealed this

First Day of July, 1997

Bruce Lehman

*Attest:*

*Attesting Officer*

BRUCE LEHMAN

*Commissioner of Patents and Trademarks*